US008181897B2

(12) United States Patent
Tsai

(10) Patent No.: US 8,181,897 B2
(45) Date of Patent: May 22, 2012

(54) WINDING DEVICE AND METHOD FOR TEARING OFF WEB MATERIAL BY PLANETARY-ROLLER

(75) Inventor: Tung-I Tsai, Taoyuan (TW)

(73) Assignee: Chan Li Machinery Co., Ltd., Taoyuan (TW)

( * ) Notice: Subject to any disclaimer, the term of this patent is extended or adjusted under 35 U.S.C. 154(b) by 239 days.

(21) Appl. No.: 12/588,271

(22) Filed: Oct. 9, 2009

(65) Prior Publication Data

US 2010/0294875 A1 Nov. 25, 2010

(30) Foreign Application Priority Data

May 22, 2009 (TW) ..... 98117010 A

(51) Int. Cl.
*B65H 35/10* (2006.01)

(52) U.S. Cl. ..... 242/521; 242/526.1; 242/532.3

(58) Field of Classification Search ..... 242/521, 242/526.1, 530.1, 532.2–532.3
See application file for complete search history.

(56) References Cited

U.S. PATENT DOCUMENTS

| | | | | |
|---|---|---|---|---|
| 5,979,818 | A * | 11/1999 | Perini et al. | 242/521 |
| 6,648,266 | B1 * | 11/2003 | Biagiotti et al. | 242/521 |
| 7,222,813 | B2 * | 5/2007 | Tsai | 242/521 |
| 7,469,856 | B1 * | 12/2008 | Tsai | 242/532.3 |
| 7,947,153 | B2 * | 5/2011 | Tsai | 162/283 |
| 2003/0037725 | A1 | 2/2003 | Daul et al. | |
| 2003/0189123 | A1 * | 10/2003 | Biagiotti et al. | 242/521 |
| 2006/0208127 | A1 | 9/2006 | Tsai | |
| 2007/0102561 | A1 * | 5/2007 | Tsai | 242/532.3 |
| 2009/0025863 | A1 | 1/2009 | Tsai | |
| 2009/0026299 | A1 * | 1/2009 | Tsai | 242/160.4 |
| 2010/0258670 | A1 * | 10/2010 | Tsai | 242/526 |

FOREIGN PATENT DOCUMENTS

| | | | |
|---|---|---|---|
| EP | 1700806 | A2 | 9/2006 |
| WO | 2007083336 | A2 | 7/2007 |

OTHER PUBLICATIONS

Communication From The European Patent Office Regarding a Counterpart Application Dated Oct. 17, 2011.

* cited by examiner

*Primary Examiner* — Sang Kim
(74) *Attorney, Agent, or Firm* — Rosenberg, Klein & Lee

(57) ABSTRACT

A winding device with a planetary-roller tear-off mechanism is disclosed, comprising a first winding roller which is driven to rotate in a predetermined direction and a plurality of core support plates that are arranged at a predetermined distance below the first winding roller, wherein an interval between the core support plates and the first winding roller is defined as a curved channel. A web material is conveyed through the curved channel to a winding zone to be wound as a roll. The planetary-roller tear-off mechanism includes a plurality of rotary arms and a plurality of planetary rollers. Each rotary arm is set at a predetermined location below the first winding roller, and having a driving end and a free end. Each planetary roller is rotatable, and mounted to the free end of the respective rotary arm. When the free end of the rotary arm is driven to rotate to a position facing a circumferential surface of the first winding roller, the web material is subjected to a drag force acting thereon to break the web material.

8 Claims, 17 Drawing Sheets

WINDING DEVICE AND METHOD FOR TEARING OFF WEB MATERIAL BY PLANETARY-ROLLER

FIELD OF THE INVENTION

The present invention relates to a winding device, and in particular to a winding device having a planetary-roller tear-off mechanism and a method for tearing off a web material.

BACKGROUND OF THE INVENTION

A conventional core used in a winding device is forwarded into a curved channel through the conveyance of a conveyor and a push plate in order to be transported to a winding zone in which a thin web material is wound on the core to form a roll, such as a toilet tissue roll and a kitchen towel roll. After the roll is completed, a cutter is employed to cut the thin web material or the rotational speed of a rotary bar is controlled to have a relative speed thereof with respect to a first winding roller or a second winding roller slower so as to induce a speed difference, which breaks or tears off the thin web material.

SUMMARY OF THE INVENTION

However, using speed difference to break a thin web material may fail for tough web materials since the irregular breaking line may be occurred, which leads to affect the product quality.

Thus, an objective of the present invention is to provide a winding device with planetary-roller tear-off mechanism in order to improve the quality of web material at the breaking line as tearing off.

The solution adopted in the present invention to overcome the technical problems of the known device is a winding device that comprises a first winding roller, a plurality of core support plates, and a planetary-roller tear-off mechanism. The first winding roller is rotatable in a predetermined direction. The plurality of core support plates are arranged at a predetermined distance below the first winding roller and an interval between the core support plates and the first winding roller is defined as a curved channel. The curved channel has an inlet end and an outlet end. A web material is fed into the inlet end of the curved channel and conveyed out the outlet end of the curved channel to reach a winding zone to be wound as a roll. The planetary-roller tear-off mechanism comprises a plurality of rotary arms and a plurality of planetary rollers. The rotary arms are set at a predetermined location below the first winding roller and each rotary arm has a driving end and a free end, wherein the driving end is coupled to a shaft. Each planetary roller serves as a passive rotatable roller and is mounted to the free end of the respective rotary arm. When the free end of the rotary arm is driven to rotate to a position facing a circumferential surface of the first winding roller, the web material is subjected to a force acting thereon to break the web material.

The solution adopted in the present invention allows a web material or a thin web material to be neatly torn off along a pre-formed perforation line without causing any irregular breaking line and the planetary rollers are effectively in tearing off web materials that are tough, whereby the quality of product can be improved and the industrial value is enhanced.

BRIEF DESCRIPTION OF THE DRAWINGS

The present invention will be apparent to those skilled in the art by reading the following description of the best mode for carrying out the present invention and preferred embodiment of the present invention, with reference being had to the attached drawings, in which.

DETAILED DESCRIPTION OF THE PREFERRED EMBODIMENTS

Figure 1:
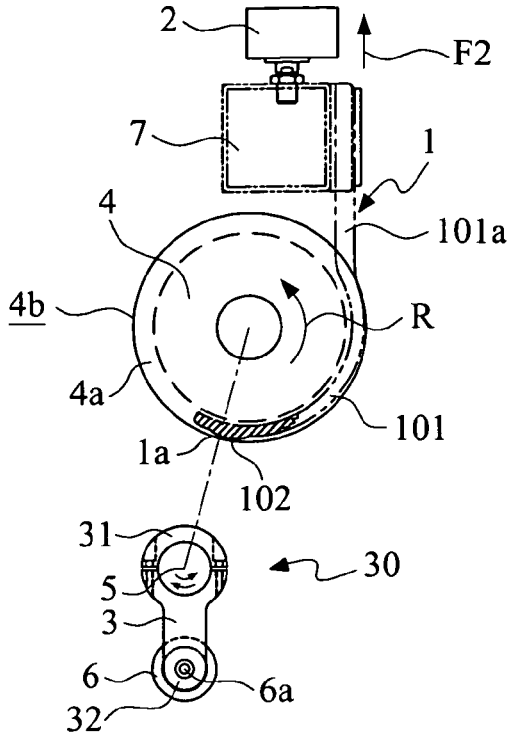
FIG. 1 is a schematic side view of a first embodiment of the present invention, showing a protuberance of an arm hidden in a groove defined in an first winding roller.
Figure 2:
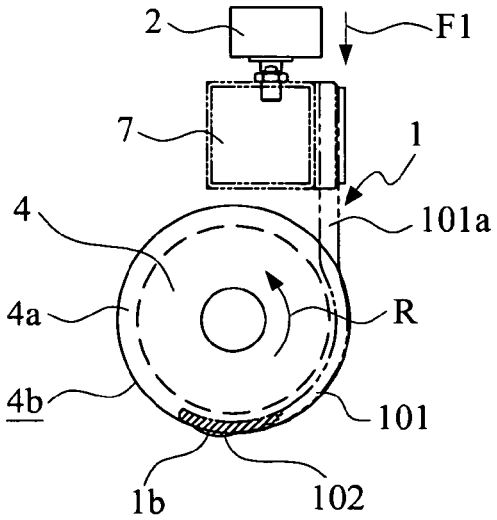
FIG. 2 is a schematic side view of a first embodiment of the present invention, showing the protuberance of the arm projecting beyond a circumferential surface of the first winding roller.
Figure 3:
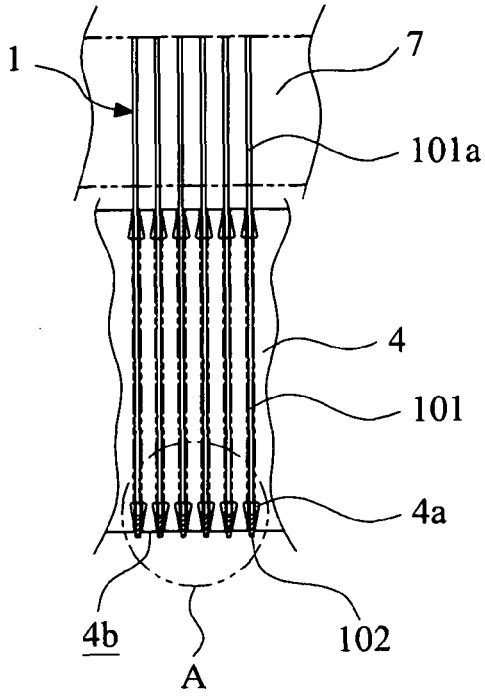
FIG. 3 is a partial front view of the first embodiment of the present invention, showing the protuberance of the arm projecting beyond the circumferential surface of the first winding roller.
Figure 4:
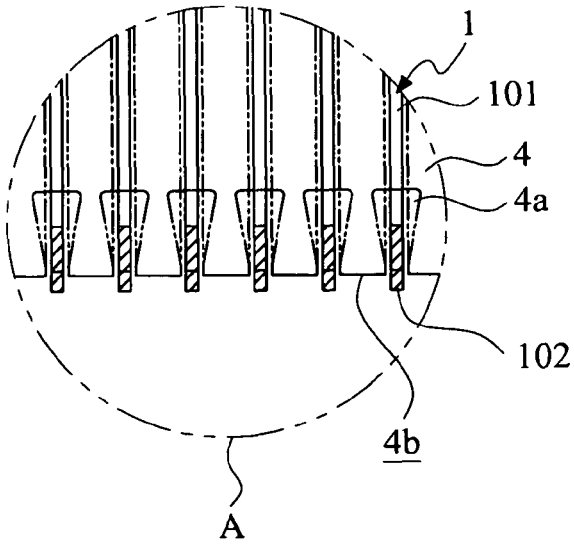
FIG. 4 is a partial enlarged view of FIG. 3.

With reference to the drawings and in particular to FIGS. 1-8, a winding device 200 constructed in accordance with the present invention comprises a first winding roller 4, a plurality of core support plates 8 (see FIG. 8), a plurality of arms 1, and a planetary-roller tear-off mechanism 30. The planetary-roller tear-off mechanism 30 comprises a plurality of rotary arms 3 and a plurality of planetary rollers 6. The first winding roller 4 is rotatable in a predetermined rotation direction R. The first winding roller 4 has a circumferential surface 4*b* in which a plurality of grooves 4*a* is defined. The plurality of core support plates 8 is set at a predetermined distance below the first winding roller 4 and an interval between the core support plates 8 and the first winding roller 4 is defined as a curved channel 9 with respect to the circumferential surface 4*b* of the first winding roller 4. The curved channel 9 forms an inlet end 9*a* and an outlet end 9*b*. A web material w is fed into the curved channel 9 through the inlet end 9*a* and conveyed out the outlet end 9*b* to reach a winding zone 14 to be rolled up as a roll L.

The plurality of arms 1 each comprises an extension section 101*a*, which is extended a circular arc portion 101 at a lower end thereof to stretch into a respective groove 4*a* defined in the first winding roller 4. The circular arc portion 101 has a bottom side facing the curved channel 9 and forming a protuberance 102. The arms 1 are driven by a controller 2 (such as power cylinder) to move up and down in a predetermined range. When the arms 1 are driven to move in a downward direction F1 to a clamping position 1*b*, the protuberances 102 of the circular arc portions 101 are projected from the circumferential surface 4*b* of the first winding roller 4. And, when the arms 1 are driven to move in an upward direction F2 to a home position 1*a*, the protuberances 102 of the circular arc portions 101 are retracted back into the grooves 4*a* of the first winding roller 4. If desired, the protuberance 102 can be eliminated and the above described operation is taken over by the circular arc portion 101 itself. (Further details of arm 1 may refer U.S. Pat. No. 7,222,813B2 assigned to the present applicant.)

The rotary arms 3 are provided at a predetermined location below the first winding roller 4. Each rotary arm 3 has a driving end 31 and a free end 32. The driving end 31 is coupled to a shaft 5 to allow the rotary arm 3 to carry out rotation with the shaft 5 as the rotation center. The planetary roller 6 serves as a passive rotatable roller and is mounted to the free end 32 of the respective rotary arm 3 to result that the planetary roller 6 is driven to rotate according to a rotation axis 6*a*. When the free end 32 of the rotary arm 3 rotates to a location facing the protuberance 102 of the circular arc portion 101 of the corresponding arm 1 and the circular arc portion 101 of the arm 1 is moved downward to the clamping position 1*b* (also see FIG. 9) to have the protuberance 102 of the circular arc portion 101 projecting beyond the circumferential surface 4*b* of the first winding roller 4, the web material w is clamped between the protuberance 102 of the circular arc portion 101 and the planetary roller 6 to temporarily stop the web material w conveying, but, on the other hand, the roll L located in the winding zone 14 is continuously rotated still, making the web material w subjected to a force acting thereon and thus torn off. The planetary roller 6 of the present invention can be made of a soft material, such as rubber or other suitable soft materials.

Figure 5:
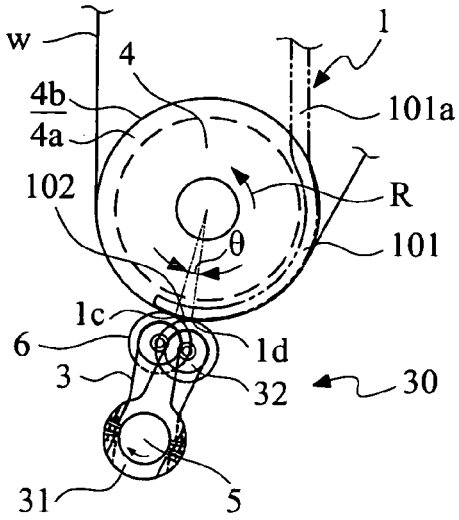
FIG. 5 is a schematic view of the first embodiment of the present invention, showing a staring point and an ending point of the operation of a planetary roller and the arm.

Referring to FIG. 5, rotation of the rotary arm 3 in a predetermined direction (clockwise direction) from a clamping starting point 1*c* between the planetary roller 6 and the protuberance 102 of the circular arc portion 101 to a clamping ending point 1*d* between the planetary roller 6 and the protuberance 102 of the circular arc portion 101 is demonstrated. In this period of time, the operation of tearing off the web material w is carried out and the angular range between the starting and ending points corresponds to an angle θ within which the movement of the web material w is temporarily stopped.

Figure 6:
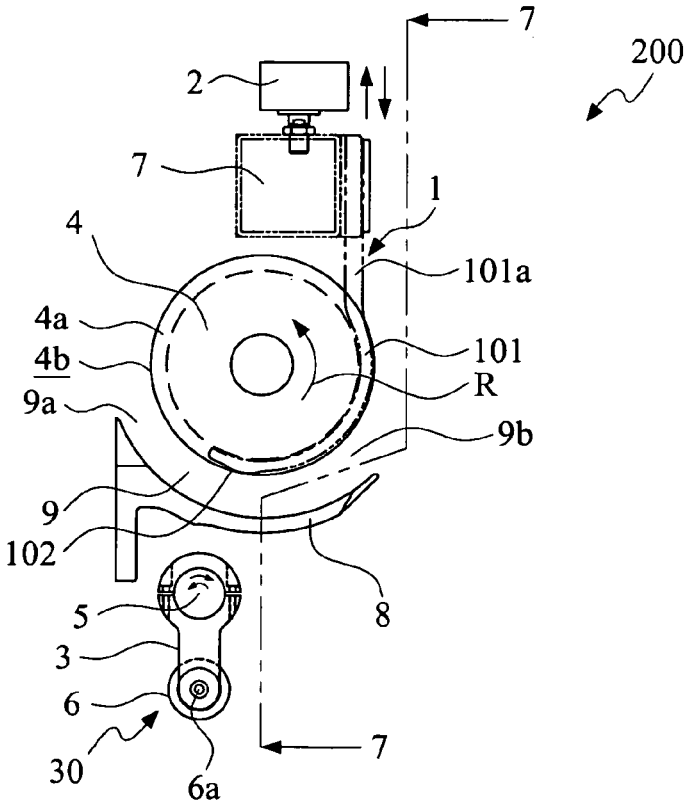
FIG. 6 is a schematic side view illustrating constituent components of a planetary-roller tear-off mechanism.
Figure 7:
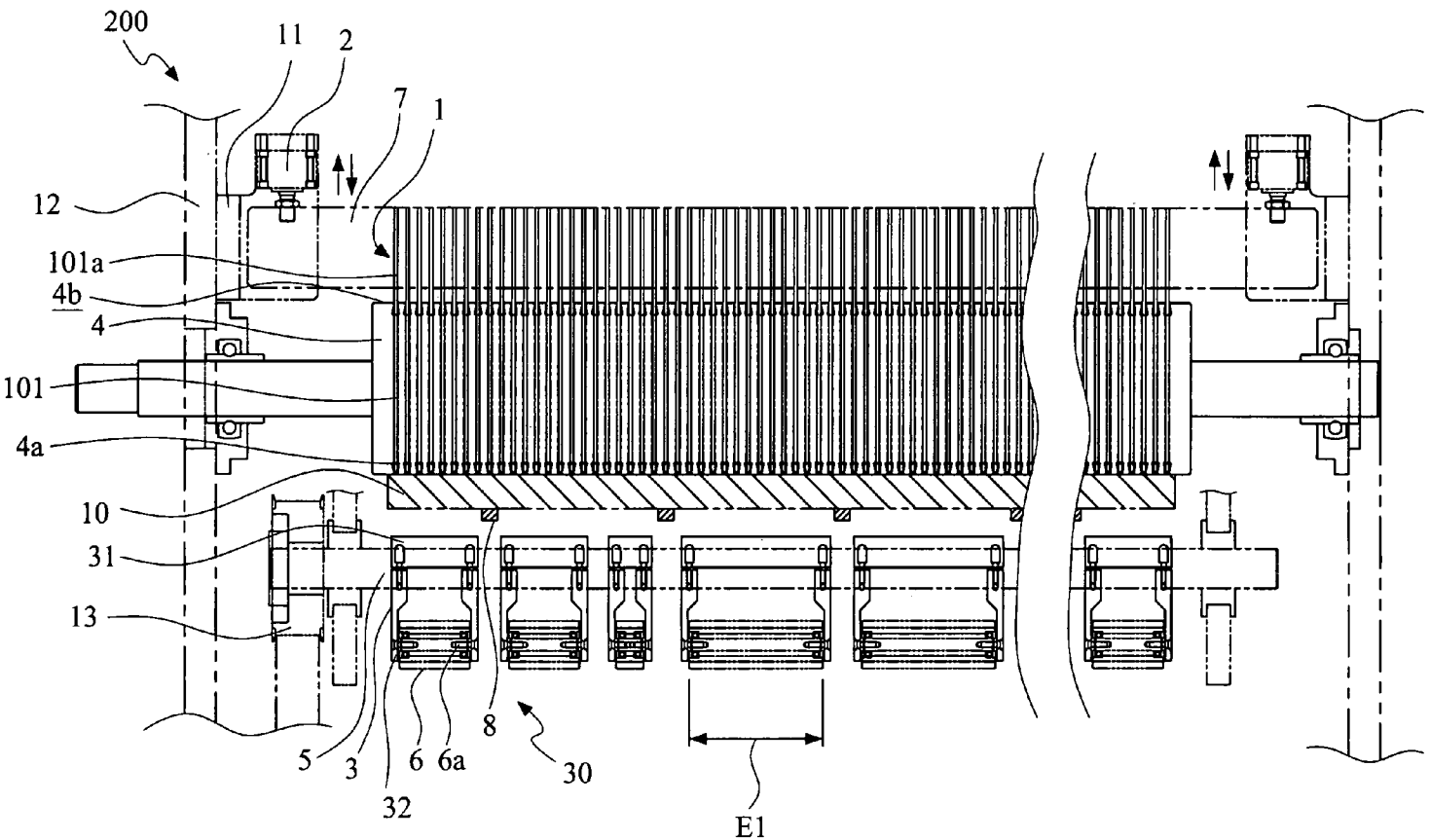
FIG. 7 is a cross-sectional view take alone line 7-7 of FIG. 6.

Referring to FIGS. 6 and 7, a controller 2 is coupled and mounted to each of at least one connection seat 11 coupled to a support rack 12. The plurality of arm 1 is coupled to a transverse bar 7 and at least one of the controllers 2 is coupled to the transverse bar 7 to drive the up-and-down movement of the arms 1 within a predetermined range. The first winding roller 4 is mounted to the support rack 12. The plurality of rotary arms 3 is mounted to a shaft 5 and is driven by a motor (not shown) through a belt 13. The shaft 5 is indirectly coupled to the support rack 12. The planetary rollers 6 are mounted to the free ends 32 of the rotary arms 3 respectively and the planetary rollers 6 may have different widths E1 to meet any practical needs. The number of the rotary arms 3 and the locations of the rotary arms 3 mounted to the shaft 5 can also be different for each rotary arm 3 in order to meet any practical needs.

Figure 8:
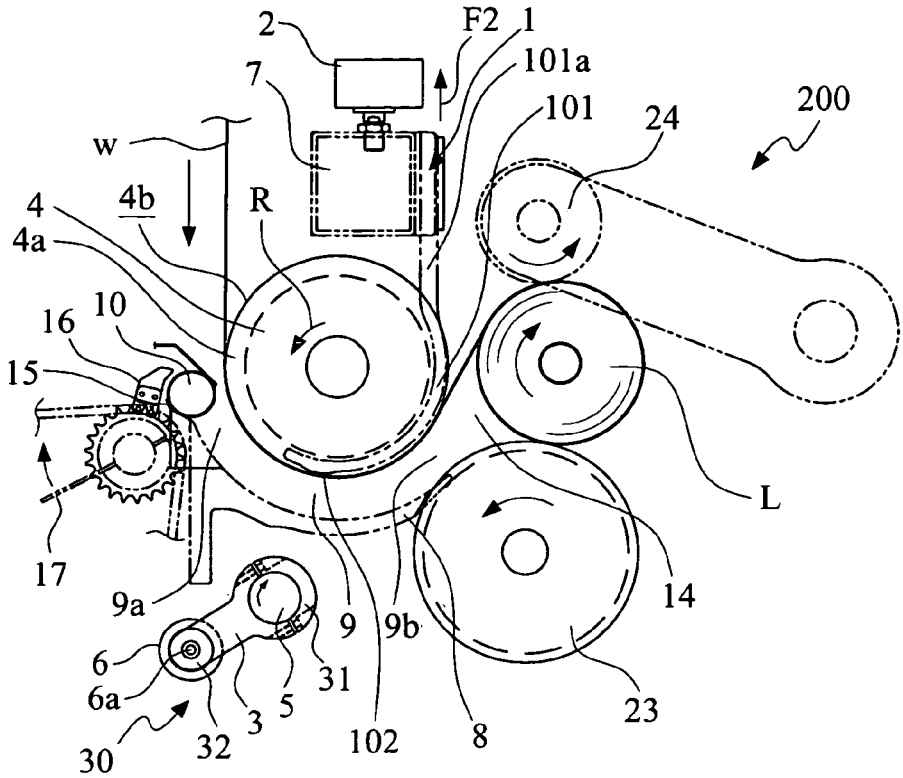
FIG. 8 is a schematic side view of the first embodiment of the present invention, showing a core is entering a curved channel.
Figure 9:
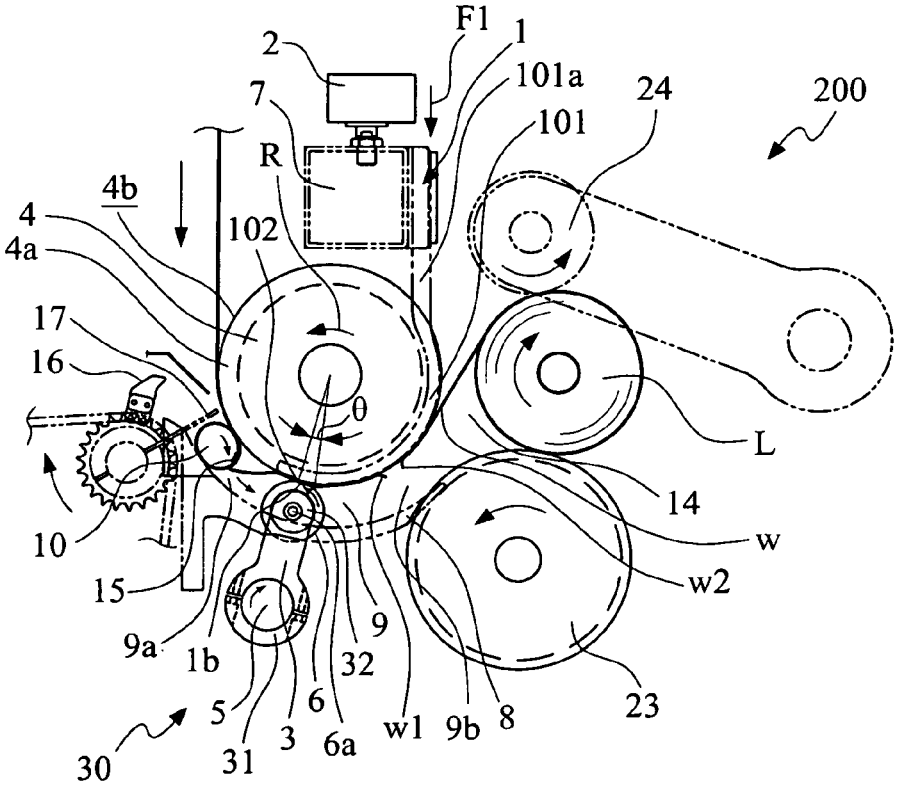
FIG. 9 is a schematic side view of the first embodiment of the present invention, showing a web material is broken.

Referring to FIGS. 8 and 9, when winding operation of a specific roll L within the winding zone 14 is about to complete, a core 10 that carries an initial glue 15 is conveyed by a carrier 16 of a conveyor (not labeled) to the inlet end 9*a* of the curved channel 9. A push plate 17 is in rotary movement and, once touching the core 10, the push plate 17 pushes the core 10 into the curved channel 9. The core 10 is then subjected to driving by the first winding roller 4 to roll forward. On the other hand, the rotary arm 3 makes a clockwise rotation to such a position where the planetary roller 6 and the protuberance 102 of the circular arc portion 101 roll and clamp the web material w therebetween to carry out tear-off operation of the web material w, whereby the web material w is broken due to a force is subjected to apply on the web material w to form separated a leading edge w1 and a trailing edge w2 of separated sections of the web material. In the operation of tearing off the web material w by clamping the web material w between the planetary roller 6 and the protuberance 102 of the circular arc portion 101, if the rotary arm 3 is set to rotate in the clockwise direction around the shaft 5, then the planetary roller 6 is set to rotate in the counterclockwise direction according to the rotation axis 6*a*, meaning the rotation direction of the planetary roller 6 according to the rotation axis 6*a* is opposite to that of the rotary arm 3 around the shaft 5.

The rotation speed of the rotary arm 3 can be high or low. For high speed rotation of the rotary arm 3, the time period in which the web material w is clamped by the protuberance 102 of the circular arc portion 101 and the planetary roller 6 and thus temporarily paused is short and the breaking force applied to the web material w is small. For low speed rotation of the rotary arm 3, the time period in which the web material w is clamped by the protuberance 102 of the circular arc portion 101 and the planetary roller 6 and thus temporarily paused is long and the breaking force applied to the web material w is great. The rotational speed of the rotary arm 3 can be adjusted according to the thickness and quality of the web material.

Figure 10:
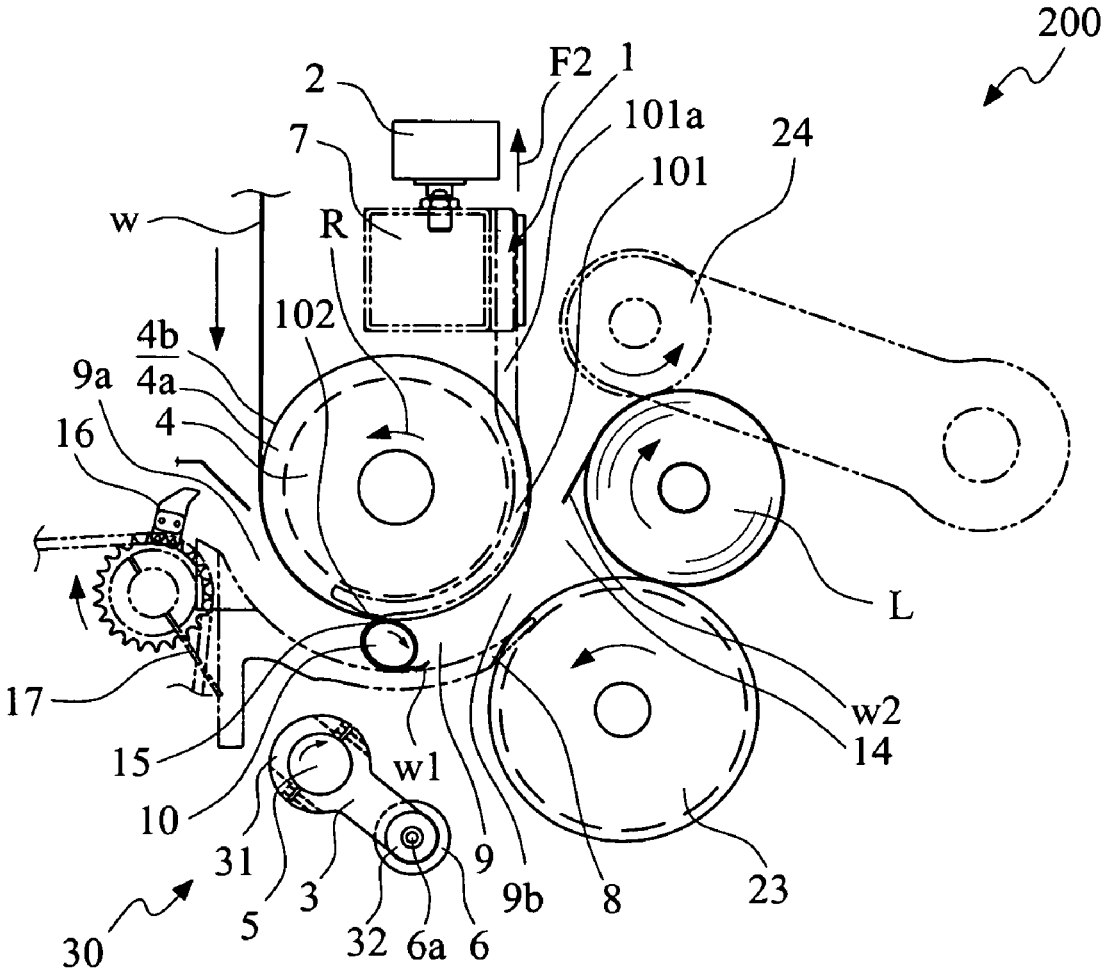
FIG. 10 is a schematic side view of the first embodiment of the present invention, showing a web material leading edge is wound on a core after the web material is broken.
Figure 11:
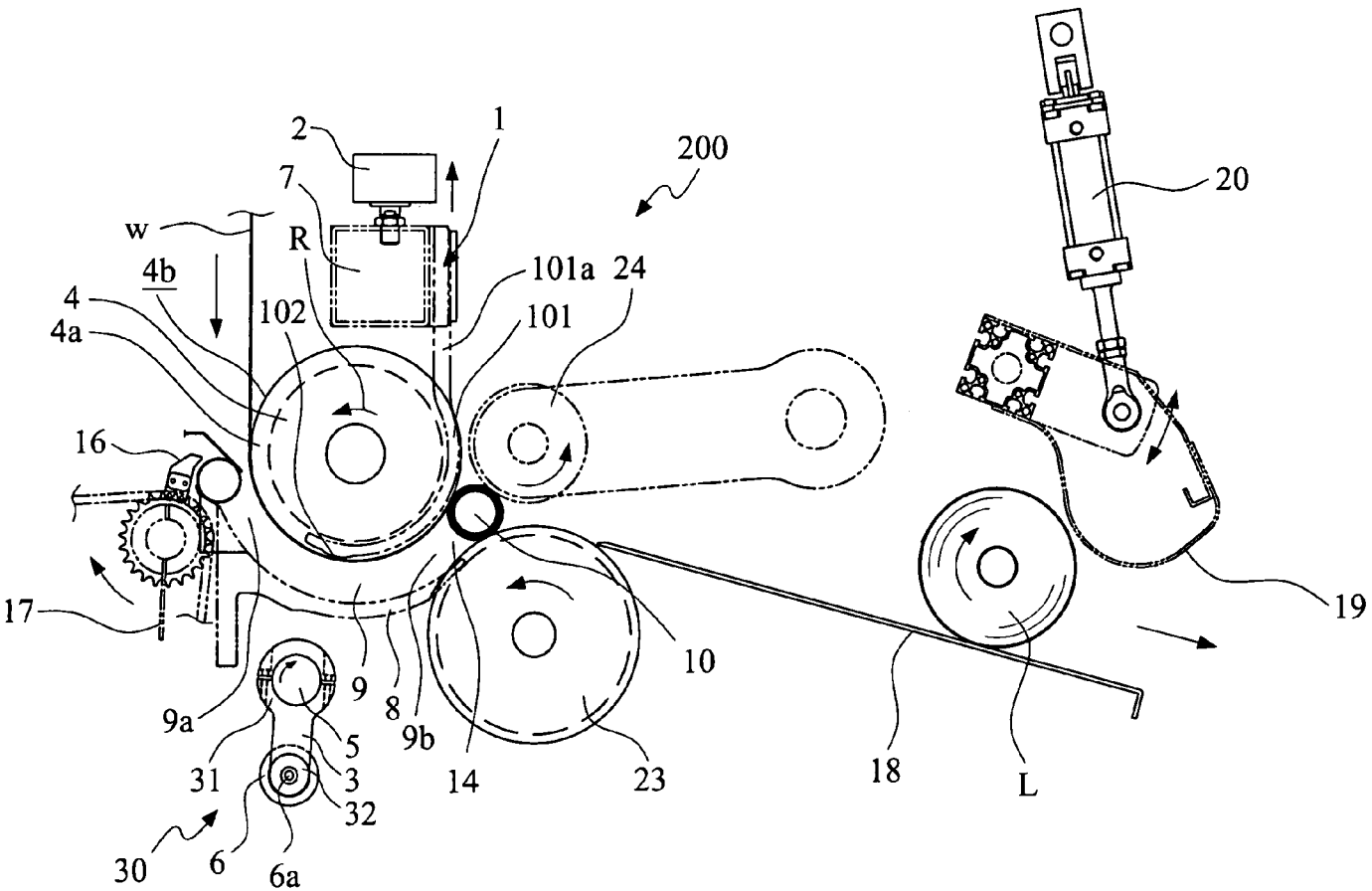
FIG. 11 is a schematic side view of the first embodiment of the present invention, showing the core is conveyed to a winding zone.

Referring to FIGS. 10 and 11, after the web material w is broken, the leading edge w1 is wound around a new core 10 and the trailing edge w2 of the web material w is wound around the previous roll L. The core 10 is then conveyed to the winding zone 14 to start a next cycle of the winding operation. The completed roll L is allowed to roll forward along an inclined chute 18 to pass a buffering baffle 19, which is controlled by a control cylinder 20 to rotate and thus move upward to allow the roll L to feed out.

Figure 12:
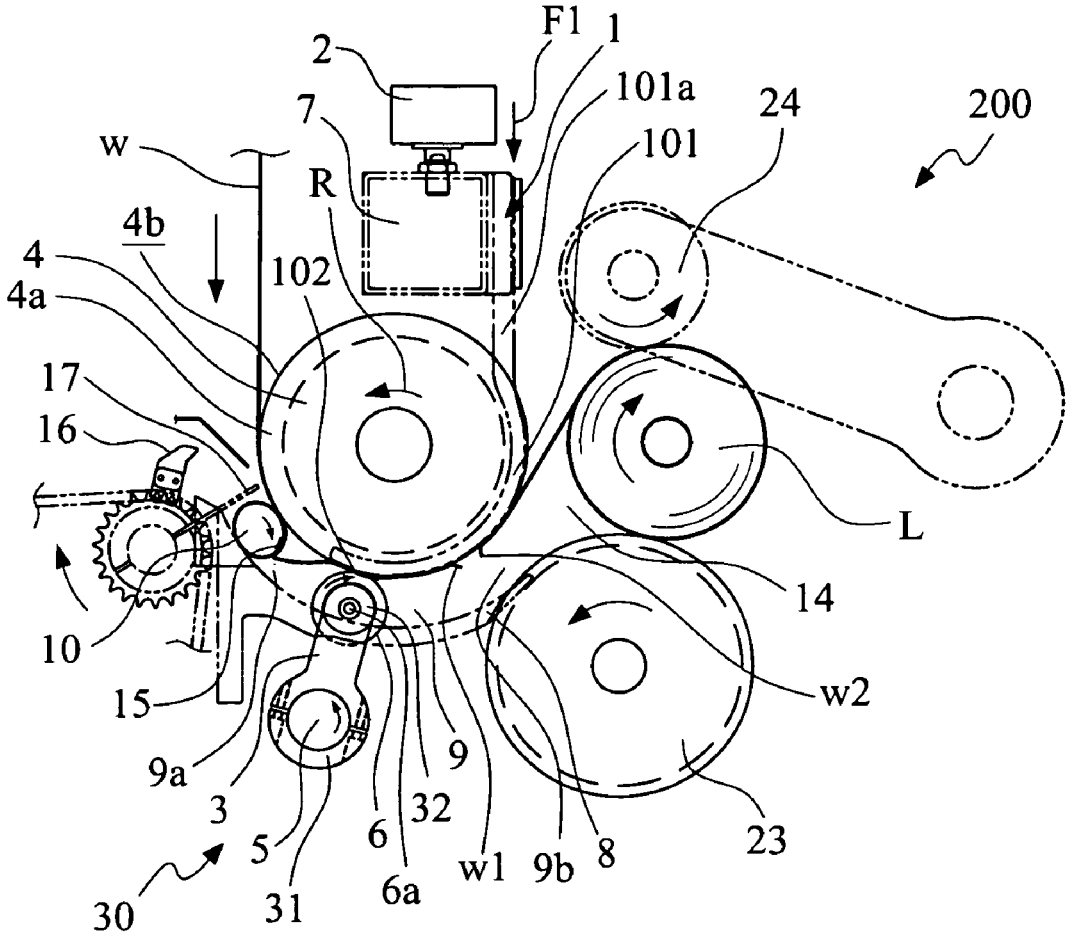
FIG. 12 is a schematic side view of the first embodiment of the present invention, showing that a rotary arm is driven to rotate in an opposite direction to break the web material.

Referring to FIG. 12, when the tear-off operation of the web material w is carried out by clamping the web material w between the planetary roller 6 and the protuberance 102 of the circular arc portion 101, if the rotary arm 3 is set to rotate in counterclockwise around the shaft 5, then the planetary roller 6 is set to rotate in clockwise direction according to the rotation axis 6*a*. The rotation direction of the rotary arm 3 can be selected as desired to meet any practical needs. Similarly, the rotational speed of the rotary arm 3 can be set according to the thickness and quality of the web material.

Figure 13:
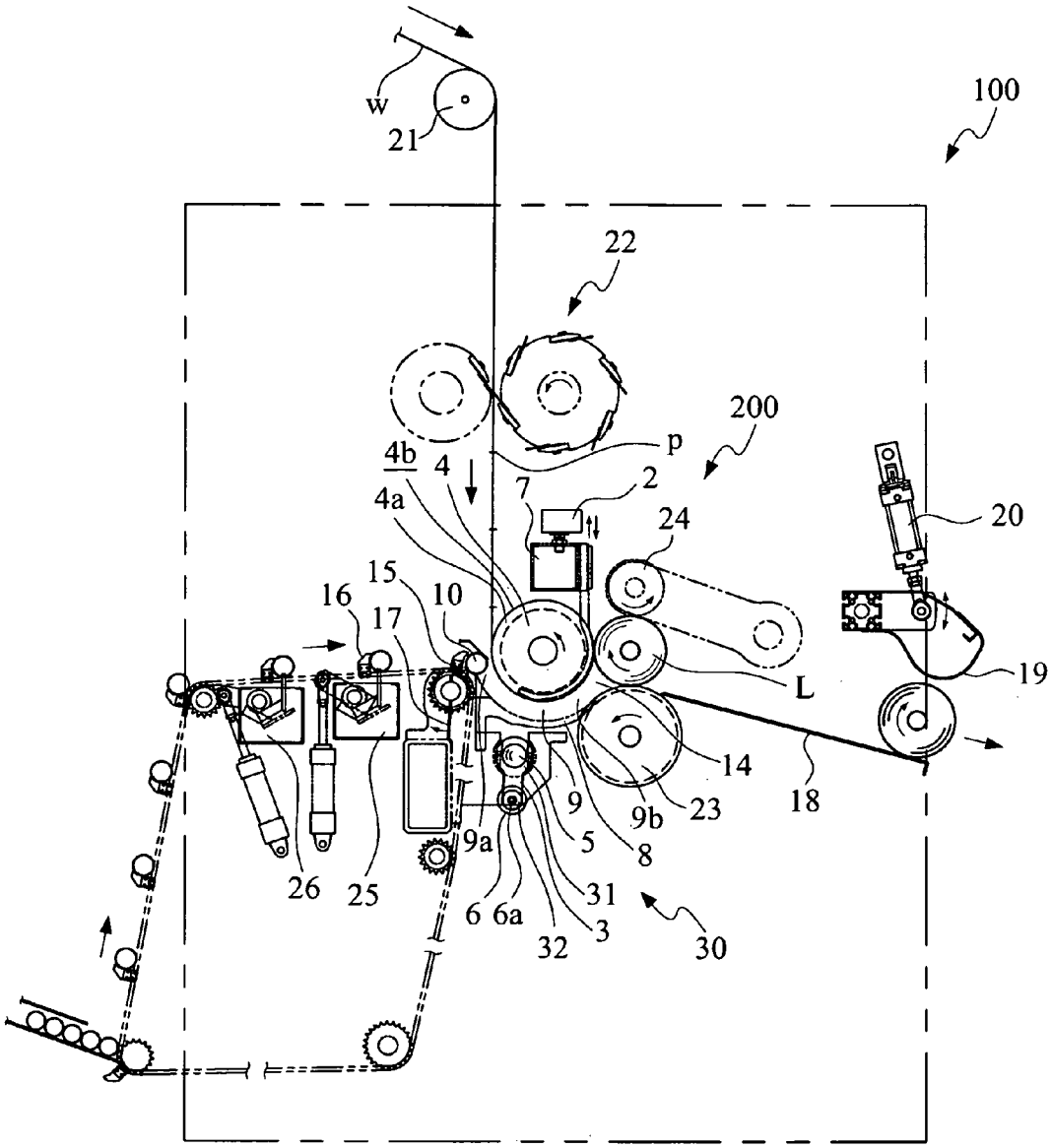
FIG. 13 is a schematic side view of the first embodiment of the present invention, showing the winding device.
Figure 14:
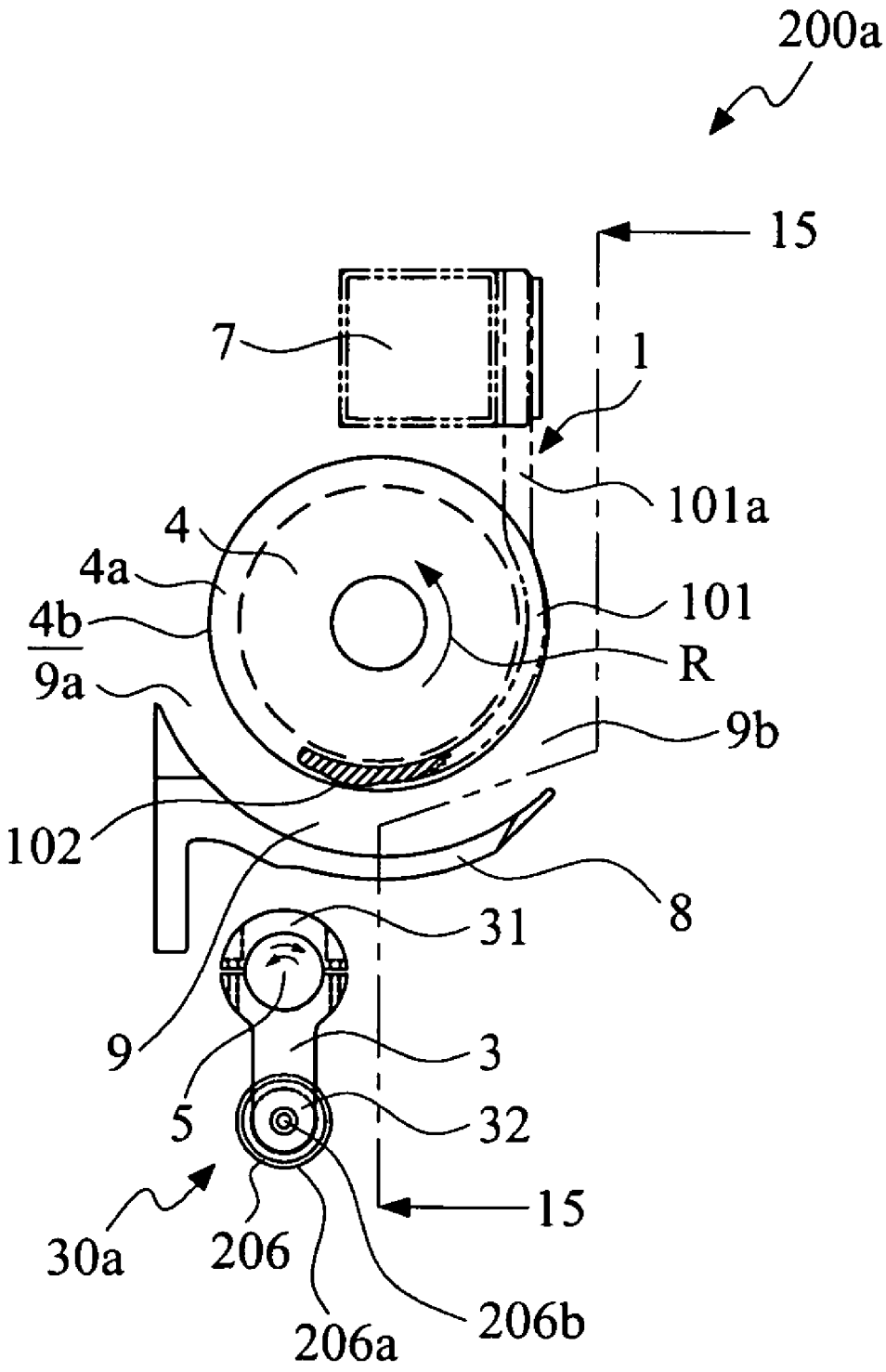
FIG. 14 is a schematic side view of a second embodiment of the present invention, showing an arm kept fixed and a protuberance of the arm hidden in a groove defined in an first winding roller.
Figure 15:
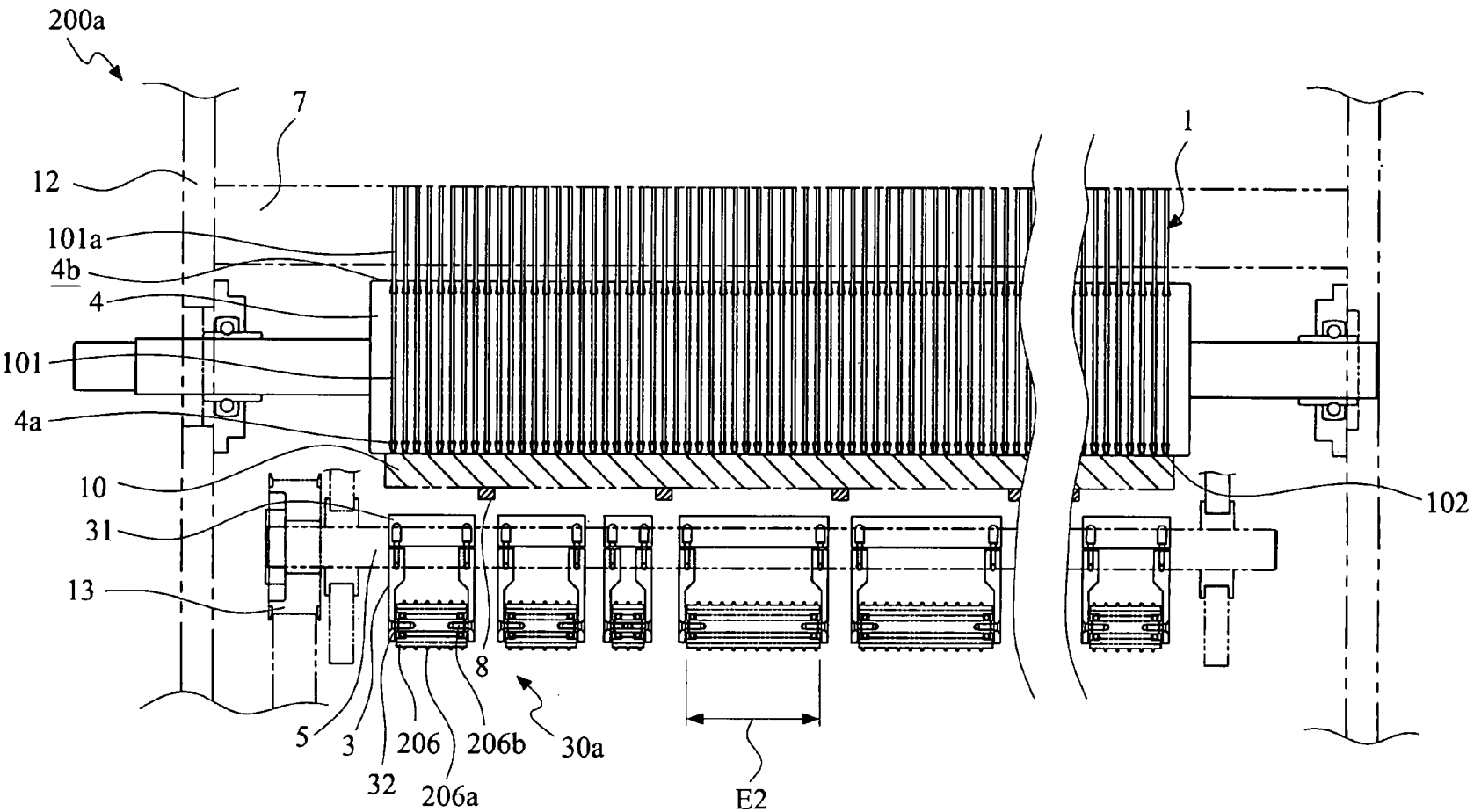
FIG. 15 is a cross-sectional view taken along line 15-15 of FIG. 14.
Figure 16:
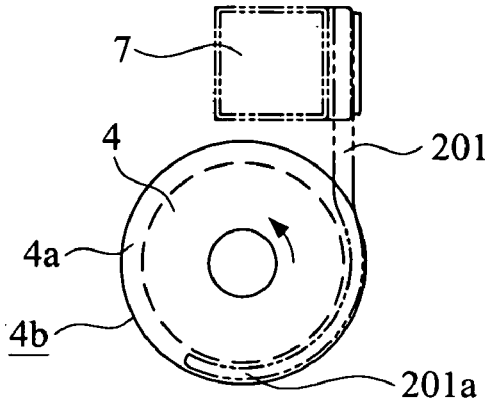
FIG. 16 is a schematic side view of the second embodiment of the present invention, showing the arm kept fixed, the protuberance removed from the arm, and a circular arc portion of the arm hidden in the groove defined in the first winding roller.
Figure 17:
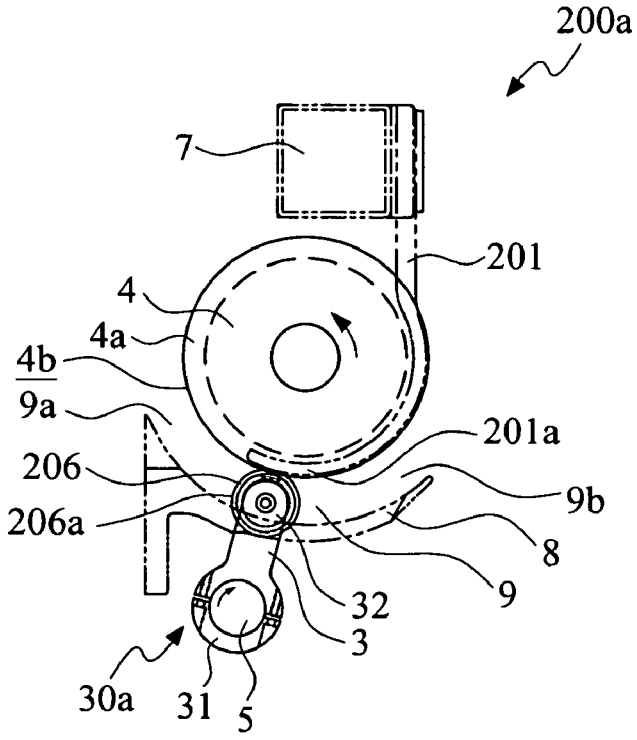
FIG. 17 is a schematic side view of the second embodiment of the present invention, showing that a rotary arm is driven to rotate to a position where a planetary roller engages the circular arc portion of the arm.
Figure 18:
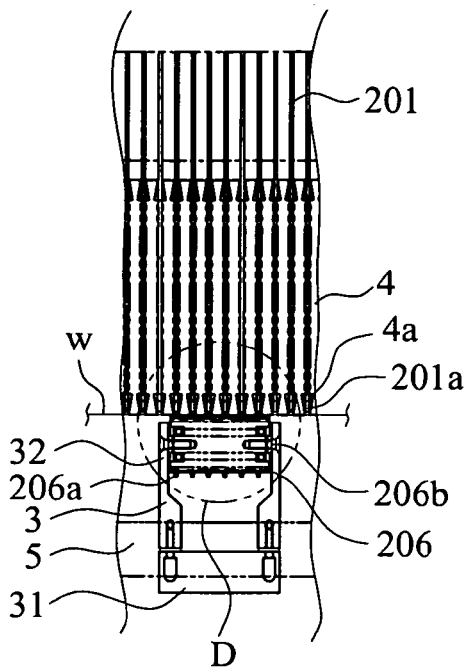
FIG. 18 is a partial front view of the second embodiment of the present invention, showing that the rotary arm is driven to rotate to a position where a planetary roller touches the circular arc portion of the arm.
Figure 19:
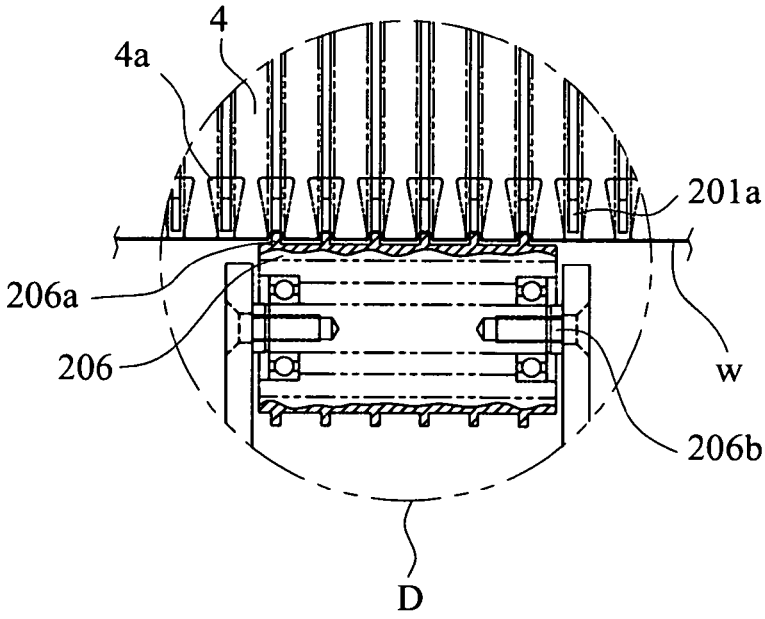
FIG. 19 is a partial enlarged view of FIG. 18.
Figure 20:
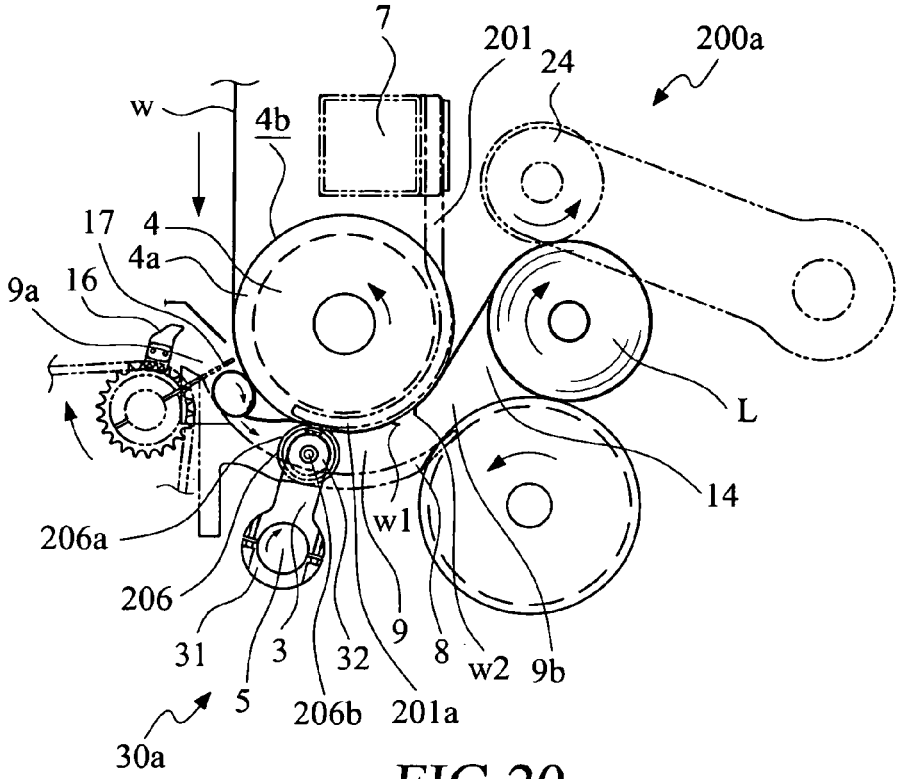
FIG. 20 is a schematic side view of the second embodiment of the present invention, showing a web material is broken.
Figure 21:
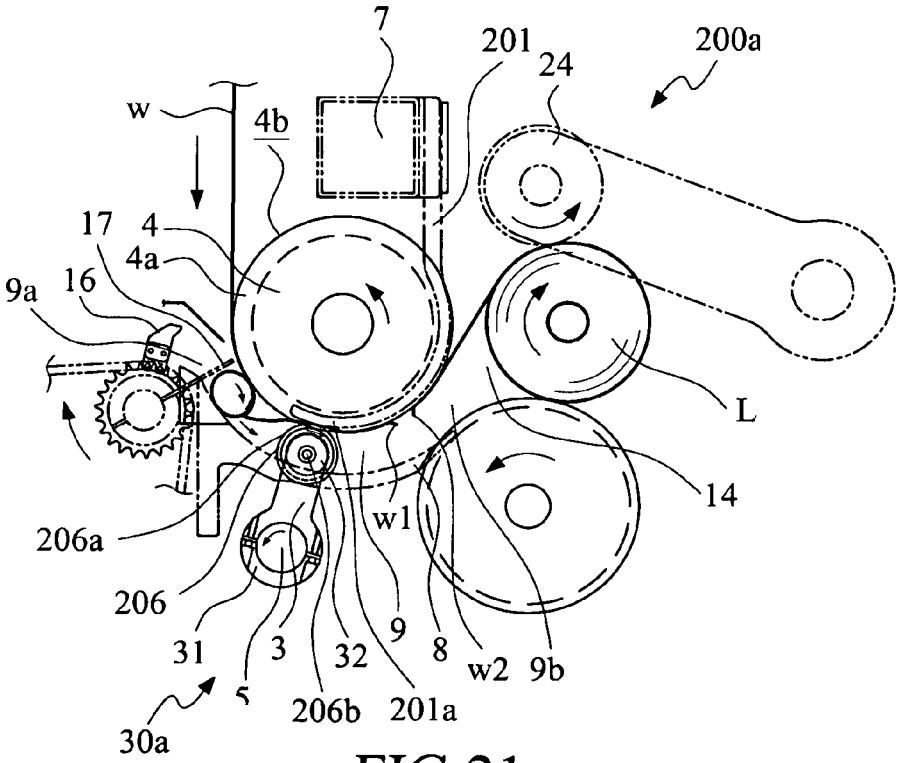
FIG. 21 is a schematic side view of the second embodiment of the present invention, showing a web material is broken with the rotary arm rotating in a direction opposite to that of FIG. 20.

Referring to FIG. 13, the winding device 200 can be mounted to a machine frame 100. A web material w, which has a predetermined width, is conveyed by a feed roller 21 to a perforation roller 22, which forms a perforation line P at every present distance in a surface of the web material w, and then extends around the first winding roller 4 to reach the winding zone 14. The winding zone 14 is defined among the first winding roller 4, a second winding roller 23, and a rider roller 24. The web material w is wound in the winding zone 14 to form a roll L of a predetermined diameter, such as a roll of tissue paper or a roll of kitchen towel. A new core 10 is conveyed by the carrier 16 to reach the inlet end 9*a* of the curved channel 9 and the push plate 17, which is set in rotation, pushes the core 10 into the curved channel 9. The core 10, once being wrapped by the winding of the web material w, is transported toward the winding zone 14 by speed difference between the first winding roller 4 and the second winding roller 23 to start a new cycle of winding operation of a new roll L. The core 10 is processed by a gluing mechanism 25 to have the core 10 coated with an initial glue 15 and, if desired, may be further processed by a perfume application mechanism 26 to be applied with perfume. A completed roll L rolls forward along the inclined chute 18 to pass through a buffering baffle 19, which is controlled by a control cylinder 20 to discharge the roll L in a controlled manner.

FIGS. 14-21 show a second embodiment of the present invention, of which the winding device, which is now designated at 200*a* for distinction, is different from that of the first embodiment in that the arms 1 are kept fixed and non-movable. The operation of the remaining parts is substantially the same as those of the first embodiment. The arms 1 are fixedly coupled to the transverse bar 7 and the transverse bar 7 is mounted to the support rack 12 (see FIGS. 14 and 15). The plurality of arms 1 each comprises an extension section 101*a* having a circular arc portion 101 extended from a lower end thereof to stretch into a respective groove 4*a* defined in the first winding roller 4. The circular arc portion 101 of the arm 1 has a bottom side facing the curved channel 9 and forming a protuberance 102. The protuberance 102 of the circular arc portion 101 is hidden within the groove 4*a* of the first winding roller 4 by a predetermined distance or the protuberance 102 is substantially flush with the circumferential surface 4*b* of the first winding roller 4. In the instant embodiment, the planetary roller, which is now designated at 206, has a circumferential surface that forms a plurality of circumferentially extending ribs 206*a* in a predetermined circumferential area to correspond to the arm 1. The planetary rollers 206 may have widths E2 that are different from each other to meet any practical needs.

In a modification of the second embodiment illustrated in FIGS. 16-19, the arms, which are now designated at 201, have circular arc portions 201*a* that do not form protuberances (the portions referred to by numeral 102 in the previous embodiment) and the circular arc portions 201*a* of the arms 201 are similarly hidden within the grooves 4*a* of the first winding roller 4 by a predetermined distance, or are arranged to be substantially flush with the circumferential surface 4*b* of the first winding roller 4.

When the free end 32 of the rotary arm 3 is driven to rotate clockwise to a location facing the circular arc portion 201*a* of the corresponding arm 201 (see FIG. 20), the web material w is clamped between the ribs 206*a* of the planetary roller 206 and the circular arc portion 201*a* of the corresponding arm 201, so that the conveyance of the web material w is temporarily halted. However, on the other hand, the roll L located in the winding zone 14 is continuously rotated, making the web material w subjected to a force acting thereon and thus torn off to form a web material leading edge w1 and a web material trailing edge w2. The planetary roller 206 is a passive rotatable roller and the rotation direction of the rotary arm 3 can be set counterclockwise as desired to meet any practical needs (see FIG. 21) for breaking the web material w. When the tear-off operation of the web material w is carried out by clamping the web material w between the ribs 206*a* of the planetary roller 206 and the circular arc portion 201*a* of the corresponding arm 201, similar to the first embodiment, the planetary roller 206 is set to rotate according to a rotation axis 206*b* in a rotation direction that is opposite to that of the rotary arm 3 rotating around the shaft 5. The rotational speed of the rotary arm 3 can be adjusted according to thickness and quality of the web material.

Figure 22:
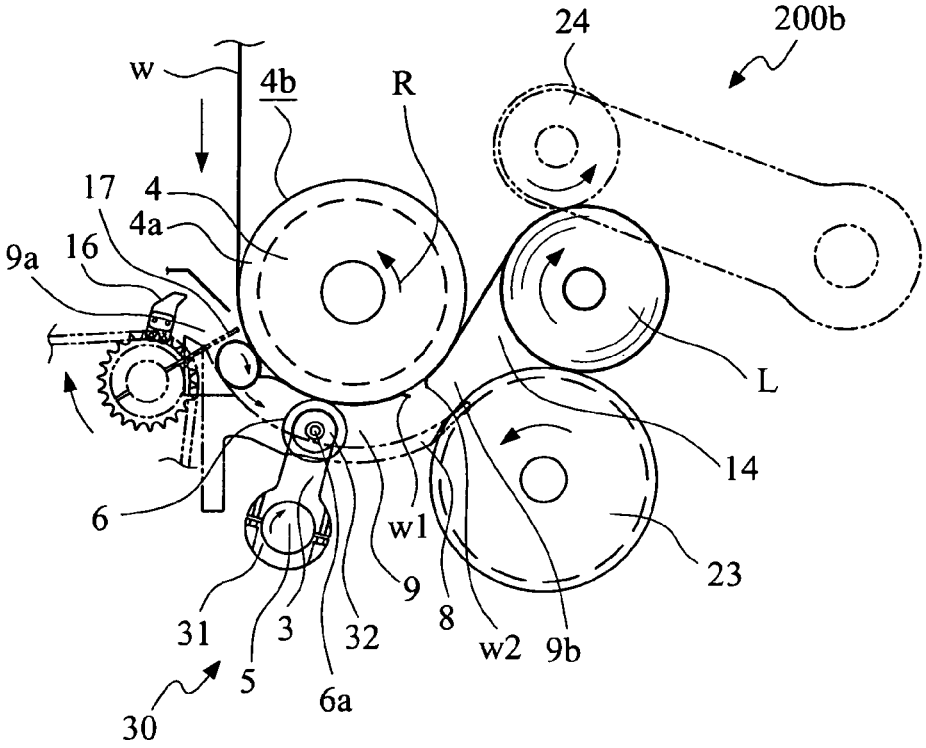
FIG. 22 is a schematic side view of a third embodiment of the present invention, showing a web material is broken.
Figure 23:
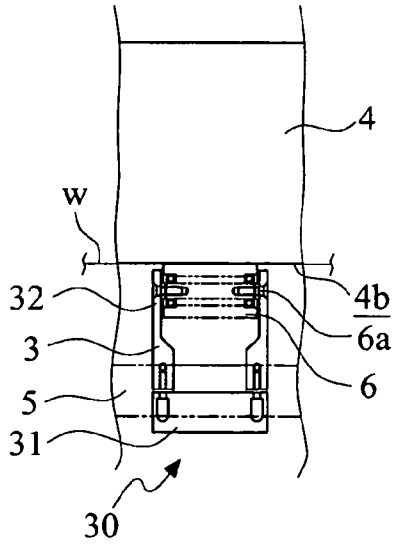
FIG. 23 is a partial front view of the third embodiment of the present invention, showing that a rotary arm is driven to rotate to a position where a planetary roller engages a first winding roller.

Referring to FIGS. 22 and 23, which illustrate a third embodiment of the present invention, the third embodiment is different from the first embodiment in that the winding device of the third embodiment, which is designated at 200*b*, does not comprise the arms 1 of the first embodiment, and when the free end 32 of the rotary arm 3 is driven to rotate clockwise around the shaft 5 to a location facing the circumferential surface 4*b* of the first winding roller 4, the planetary roller 6 is driven by the first winding roller 4 to rotate according to the rotation axis 6*a*, by which the web material w is clamped between the planetary roller 6 and the circumferential surface 4*b* of the first winding roller 4. On the other hand, the roll L located within the winding zone 14 is accelerated by the rider roller 24 so as to apply a force to and thus break the web material w to form a-web material leading edge w1 and a web material trailing edge w2. The rotational speed of the rotary arm 3 can be adjusted according to the thickness and quality of the web material to meet any practical needs. The planetary roller 6 of the instant embodiment can be modified to remove the characteristic configuration defined by the ribs 206*a* and the first winding roller 4 is modified to remove the characteristic configuration of the grooves 4*a*. The rotary arm 3 can be set to rotate in the counterclockwise direction to meet any practical needs for breaking the web material w.

Figure 24:
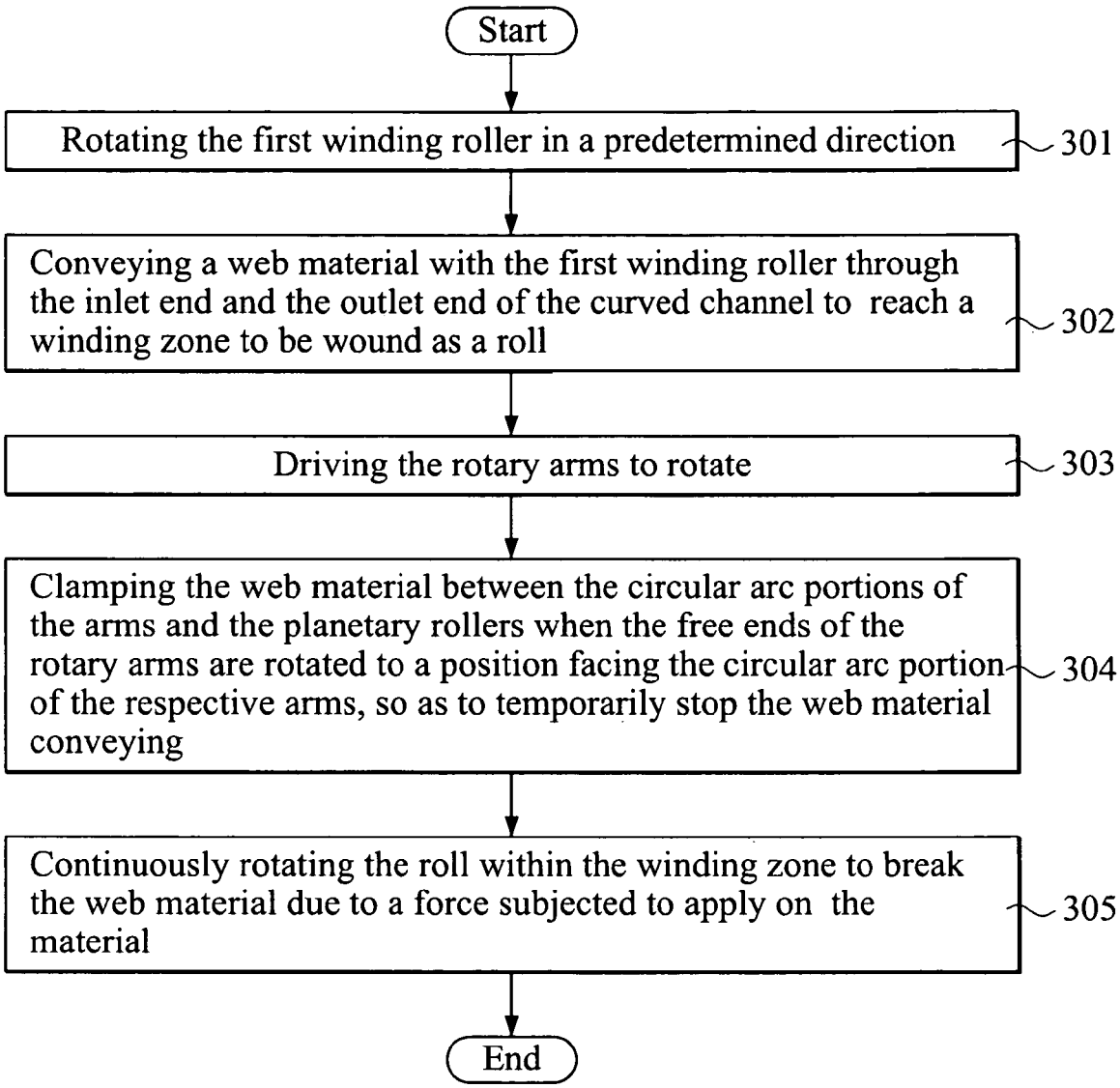
FIG. 24 shows a flowchart of operation corresponding to the first and second embodiments of the present invention.

Referring to FIG. 24, which shows a flowchart of operation corresponding to the first and second embodiments discussed above, as shown, the first winding roller 4 is driven to rotate in a predetermined direction R (Step 301). A web material w is conveyed by the first winding roller 4 through the inlet end 9*a* of the curved channel 9 and the outlet end 9*b* of the curved channel 9 to reach the winding zone 14 where the web material w is wound to form a roll L (Step 302). When the winding of the roll L is about to complete, the rotary arm 3 is driven to rotate (Step 303) so that when the free end 32 of the rotary arm 3 is driven to rotate to a position facing the circular arc portion 101 of the arm 1, the web material w is subjected to clamping by the circular arc portion 101 of the arm 1 and the planetary roller 6 to temporarily stop the web material w conveying (Step 304). The roll L that is located in the winding zone 14 is continuously wound to break the web material w due to a force is subjected to apply on the web material w (Step 305).

Figure 25:
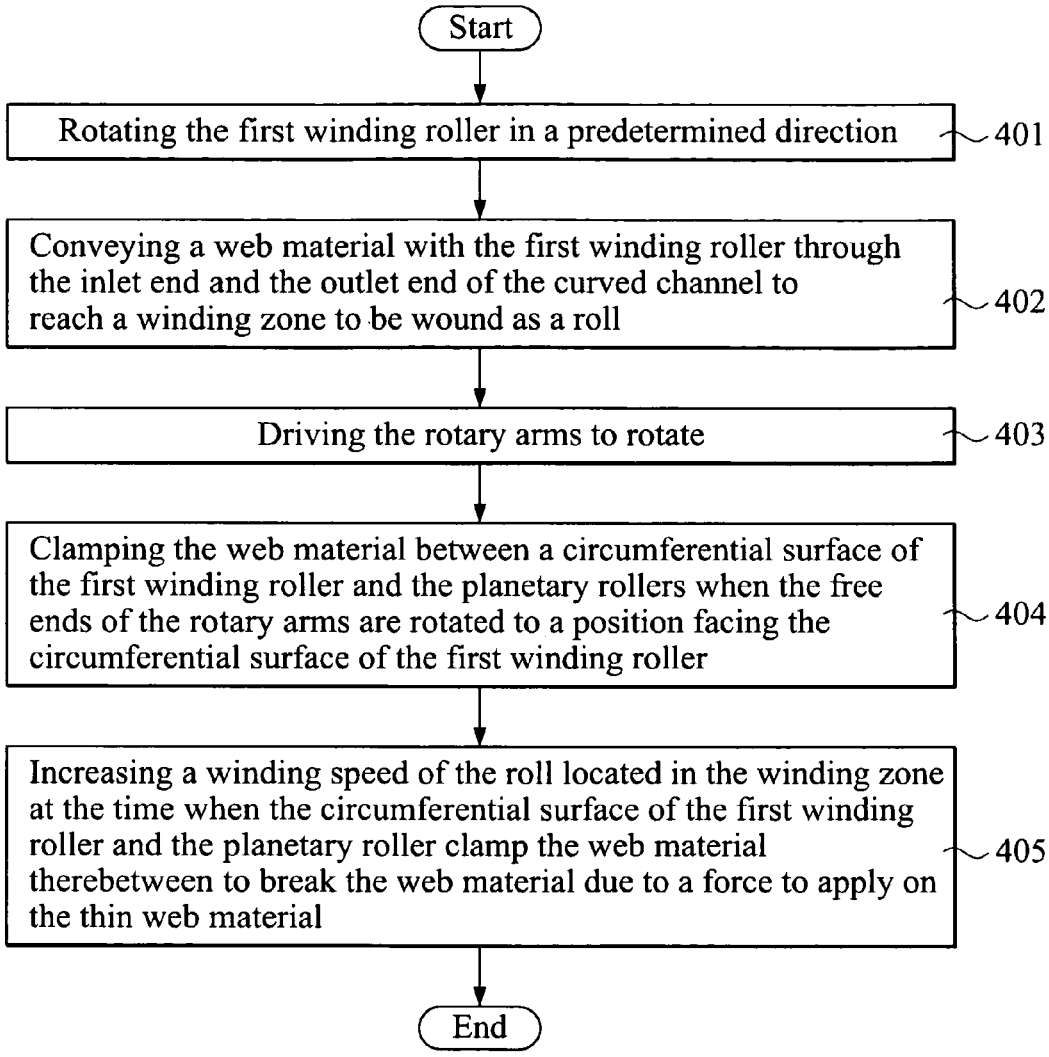
FIG. 25 shows a flowchart of operation corresponding to the third embodiment of the present invention.

Referring to FIG. 25, which shows a flowchart of operation corresponding to the third embodiment discussed above, as shown, the first winding roller 4 is driven to rotate in a predetermined direction R (Step 401). A web material w is driven by the first winding roller 4 to the inlet end 9*a* of the curved channel 9 and the outlet end 9*b* of the curved channel 9 to reach the winding zone 14 where the web material w is wound to form a roll L (Step 402). When the winding of the roll L is about to complete, the rotary arm 3 is driven to rotate (Step 303) so that when the free end 32 of the rotary arm 3 is driven to rotate to a position facing the circumferential surface 4*b* of the first winding roller 4, the web material w is subjected to clamping by the circumferential surface 4*b* of the first winding roller 4 and the planetary roller 6 (Step 404). At the time period when the web material w is clamped between the circumferential surface 4*b* of the first winding roller 4 and the planetary roller 6, the winding speed of the roll L within the winding zone 14 is increased so that the web material w breaks the web material w due to a force is subjected to apply on the web material (Step 405). The roll L within the winding zone 14 is accelerated by the rider roller 24.

Although the present invention has been described with reference to the best mode for carrying out the present invention, as well the preferred embodiments of the present invention, it is apparent to those skilled in the art that a variety of modifications and changes may be made without departing from the scope of the present invention which is intended to be defined by the appended claims.

What is claimed is:

1. A winding device, comprising:

a first winding roller, which is rotatable in a predetermined direction and has a circumferential surface that defines a plurality of grooves;

a plurality of core support plates, which is arranged at a predetermined distance below the first winding roller, an interval between the core support plates and the first winding roller being defined as a curved channel, having an inlet end and an outlet end, wherein a web material is fed into the inlet end and conveyed out the outlet end to reach a winding zone where the web material is wound as a roll;

a plurality of arms, each comprising an extension section, which is extended a circular arc portion at a lower end thereof to stretch into a respective groove of the first winding roller, the circular arc portion having a bottom side facing the curved channel and forming a protuberance, wherein when the arms are driven to move downward to a clamping position, the protuberances of the circular arc portions are projected from the circumferential surface of the first winding roller; and when the arms are driven to move upward to a home position, the protuberances of the circular arc portions are retracted back into the grooves of the first winding roller; and a planetary-roller tear-off mechanism comprising:

a plurality of rotary arms, which is set at a predetermined location below the first winding roller, each rotary arm having a driving end and a free end, wherein the driving end is coupled to a shaft, and a plurality of planetary rollers, each of which serves as a passive rotatable roller and is mounted to the free end of the respective rotary arm to result that the planetary roller is driven to rotate according to a rotation axis, wherein when the free end of the rotary arm rotates to a location facing the protuberance of the circular arc portion of the respective arm and the circular arc portion of the arm is moved downward to the clamping position to have the protuberance of the circular arc portion projecting beyond the circumferential surface of the first winding roller, the web material is clamped between the protuberance of the circular arc portion and the planetary roller to temporarily stop the web material conveying, and the roll located in the winding zone being continuously rotated still, the web material is subjected to a force acting thereon and thus torn off.

2. The winding device as claimed in claim 1, wherein the rotary arm is driven to rotate around the shaft in a rotation direction identical to the predetermined rotation direction of the first winding roller.

3. The winding device as claimed in claim 1, wherein the rotary arm is driven to rotate around the shaft in a rotation direction opposite to the predetermined rotation direction of the first winding roller.

4. The winding device as claimed in claim 1, wherein when the web material is clamped between the protuberance of the circular arc portion and the planetary roller, the planetary roller is driven to rotate according to the rotation axis in a direction opposite to a direction of rotation of the rotary arm around the shaft.

5. A method for tearing off a web material in a winding device, which comprises an first winding roller, a plurality of core support plates, a plurality of arms, and a planetary-roller tear-off mechanism, wherein the core support plates are arranged at a predetermined distance below the first winding roller and a curved channel is defined between the core support plates and the first winding roller, the curved channel having an inlet end and an outlet end, each arm having a circular arc portion, wherein the planetary-roller tear-off mechanism comprises a plurality of rotary arms and a plurality of planetary rollers, the rotary arms being set at a predetermined location below the first winding roller, each rotary arm having a driving end coupled to a shaft, and a free end, each planetary roller serving as a passive rotatable roller and being mounted to the free end of the respective rotary arm to be driven to rotate according to a rotation axis, the method comprising the following steps of:

(a) rotating the first winding roller in a predetermined direction;

(b) conveying the web material through the inlet end and the outlet end of the curved channel by driving the first winding roller to reach a winding zone to be wound as a roll;

(c) driving the rotary arms to rotate;

(d) clamping the web material between the circular arc portions of the arms and the planetary rollers when the free ends of the rotary arms are rotated to a position facing the circular arc portions of the respective arms, so as to temporarily stop the web material conveying; and (e) continuously rotating the roll within the winding zone to break the web material due to a force is subjected to apply on the web material.

6. The method as claimed in claim 5, wherein the rotary arms are driven to rotate around the shaft in a rotation direction identical to the predetermined rotation direction of the first winding roller.

7. The method as claimed in claim 5, wherein the rotary arms are driven to rotate around the shaft in a rotation direction opposite to the predetermined rotation direction of the first winding roller.

8. The method as claimed in claim 5, wherein when the web material is clamped between the circular arc portions and the planetary rollers, the planetary rollers are driven to rotate according to the rotation axis in a direction opposite to a direction of rotation of the rotary arms around the shaft.

* * * * *